United States Patent [19]

Chou et al.

[11] 4,232,623

[45] Nov. 11, 1980

[54] APPARATUS TO REDUCE VESSEL MOTIONS

[75] Inventors: Frank S. F. Chou; David P. Tuturea; Graham J. Blight, all of Houston, Tex.

[73] Assignee: Brown & Root, Inc., Houston, Tex.

[21] Appl. No.: 854,652

[22] Filed: Nov. 25, 1977

[51] Int. Cl.[3] ..... B63B 39/03

[52] U.S. Cl. ..... 114/125; 114/122

[58] Field of Search ..... 114/264–267, 114/61, 121–125; 9/8 P

[56] References Cited

U.S. PATENT DOCUMENTS

| | | | |
|---|---|---|---|
| 2,024,822 | 12/1935 | Hort | 114/125 |
| 3,198,157 | 8/1965 | Livas | 114/123 |
| 3,299,846 | 1/1967 | Jarlan | 114/125 |
| 3,349,743 | 10/1967 | Field | 114/125 |
| 3,513,797 | 5/1970 | Frankel | 114/125 |
| 3,965,837 | 6/1976 | Michael | 114/125 |

*Primary Examiner*—Trygve M. Blix
*Assistant Examiner*—D. W. Keen
*Attorney, Agent, or Firm*—Kenway & Jenney

[57] ABSTRACT

The invention relates to apparatus for reducing the relative motion of a vessel and for reducing the intensity of waves reflected from the vessel. According to the invention, the vessel is provided with at least two specially designed tanks or cavities, one on the starboard side of the vessel and one on the port side of the vessel. The tanks extend above and below the mean water line of the vessel. In one embodiment of the invention, each tank has (a) a bottom plate which extends substantially laterally outward from at least a portion of the bottom of the vessel and which is freely accessible to the surrounding water; (b) vertically aligned, transversely extending, outwardly directed, perforate plates which are spaced apart along a longitudinal length of the tank, and (c) a vertically aligned, longitudinally extending perforate plate or bulkhead which is spaced apart from the vessel along a longitudinal length of the tank. In other embodiments, more than one perforate longitudinally extending bulkhead or baffle is provided between the bottom plate and a laterally extending upper member to further reduce the intensity of waves reflected from the vessel. In another aspect of the invention, buoyancy chambers may be provided to counterbalance the weight added by the perforate plates, bulkheads, and the bottom plate. In yet another aspect of the invention, only longitudinal bulkheads are used in combination with the buoyancy chambers to reduce the relative motion of the vessel.

14 Claims, 15 Drawing Figures

APPARATUS TO REDUCE VESSEL MOTIONS

This invention relates to apparatus for reducing the relative motion of a vessel and in particular to apparatus for primarily reducing roll and heave of a vessel.

BACKGROUND OF THE INVENTION

Large vessels, for example barges, have been and are being used in petroleum related activities such as, for example, pipe laying, well drilling, and assemblying offshore platforms. In general, these vessels should be maintained substantially stationary so that the work in which the vessel is engaged may proceed in an orderly and predictable fashion. As petroleum exploration ventures into more severe environments, for example the North Sea area, the problem of providing a stable and immobile vessel has increased dramatically. In these environments, waves on the order of ten to fifteen feet are not uncommon and to maintain the vessel within the specified limits of motion, for example a roll of less than two degrees and a pitch of less than one degree, is very difficult.

A related problem in adverse sea conditions relates to the relative motion and effectiveness of various smaller service craft which are typically found alongside the larger vessel. These craft have relatively high resonant frequencies and are highly responsive to wave action, much more than the larger vessels which they serve. In particular, waves reflected by the larger vessels, which will have a crest to trough amplitude of approximately twice the amplitude of the waves incident to the vessel, sometimes pose a threat to the service craft. Thus, reflected waves can and often do disturb and disrupt the normal activities of the service craft.

Various methods and structures have been developed to cope with the problems outlined above. To control motions of the vessel, many vessels use complex active apparatus to shift fluids from one portion of the vessel to another. Others use passive systems also involving moving fluids. Still further apparatus provide open tanks attached to the sides of the vessel which tend to reduce roll and reflected wave action. While many of these structures have tended to reduce the motions of the vessel, none has proven completely adequate from a practical point of view.

It is therefore an object of this invention to provide a passive structure attached to and forming a part of the sides of the vessel which further reduces the motions of the vessel and which also provides significantly reduced reflective wave action. It is a further object of the invention to provide apparatus to dampen the residual responses of the vessel and to maintain a desired mean water line for the vessel.

It is a further object of this invention to provide an apparatus which is simple in construction, which does not interfere with the normal sea going operations of the vessel, which may provide additional deck area, which does not interfere with docking of the vessel, and which enables the vessel to operate successfully in otherwise adverse conditions.

SUMMARY OF THE INVENTION

The invention features a floating vessel having apparatus for reducing its relative motions. The apparatus comprises at least a pair of water accessible cavities, one cavity on the starboard side of the vessel and one cavity on the port side of the vessel. Each cavity extends at least a portion of the longitudinal length of the vessel and has a portion which extends above the mean water line of the vessel and a portion which extends below the mean water line of the vessel. Each cavity is bounded at its top by the underside surface of a laterally extending upper member. The upper member extends laterally outward from an above-water portion of the vessel for substantially the entire length of the cavity. Each cavity is bounded at its bottom by an upper side surface of a bottom section. The bottom section has a bottom plate extending substantially laterally outward from a bottom portion of the vessel for substantially the length of the cavity. Preferably, the bottom section has a vertical thickness of less than one-fifth of its lateral width.

Each cavity is bounded at its innermost section by the outer surface of the vessel hull and has a longitudinally directed, vertically aligned, perforate bulkhead, attached between the upper member and the bottom section, Which substantially encloses the cavity. According to one aspect of the invention, each cavity is then divided into a plurality of longitudinally spaced water accessible compartments by a plurality of transversely extending substantially vertically aligned perforated plates. Each transverse plate is structurally secured between the hull, the bottom section, and the extending upper member. The transverse plates are spaced apart along the length of the cavity.

The invention may also be used in connection with an existing vessel by retrofitting the vessel with tanks having the desired properties. In that embodiment, the invention features tanks having a portion which extends above the mean water line of the vessel and a portion which extends below the mean water line of the vessel, and each tank extends at least a portion of the longitudinal length of the vessel.

Each of the tanks has a bottom plate, an upper member, and a plurality of transversely extending substantially vertically aligned perforate plates. The bottom plate extends substantially laterally outward from a bottom portion of the vessel for substantially the entire tank. In the specific case of a barge which has a substantially flat bottom, the bottom plate extends laterally out from and parallel to the bottom of the vessel. The upper member extends laterally outward from an upper portion of the vessel for substantially the entire length of the tank. The upper member may have about the same width as the bottom plate. The transverse plates are structurally connected between the vessel, the bottom plate, and the upper member. The transverse plates are spaced apart along the length of the tank and may have substantially the same width as the bottom plates. The tanks also each include at least one perforate longitudinally extending vertically aligned bulkhead plate extending substantially the length of the tank. Each bulkhead plate is secured between the bottom plate and upper member. There is thus formed a plurality or array of longitudinally spaced wave energy dissipating cells or compartments, each cell having at least two perforate side walls.

In one particular aspect of the invention, the apparatus features at least one pair of buoyancy chambers, one chamber on the starboard side of the vessel and one chamber on the port side of the vessel, each buoyancy chamber being positioned preferably beneath a tank or cavity on that respective side of the vessel. Each buoyancy chamber extends substantially the longitudinal length of the tank or cavity. Each chamber has as its upper boundary an underside portion of the bottom plate of the tank or cavity; and each buoyancy chamber has an underplate which extends outwardly from the vessel and means for sealingly connecting the bottom plate and the underplate. The vertical distance between the bottom plate upper surface and the underplate lower surface is no greater than about one-fifth of the lateral width of the chamber in order to obtain the desired motion damping characteristics for the vessel. Preferably, the underplate extends outwardly and downwardly from the vessel and the underplate and bottom plate may have a common connection line with the vessel.

In another particular embodiment, the invention features a floating vessel having at least one pair of water accessible cavities, one cavity on the starboard side of the vessel and one cavity on the port side of the vessel. Each cavity extends at least a portion of the longitudinal length of the vessel and has a portion which extends above the mean water line of the vessel and a portion which extends below the mean water line of the vessel. Each cavity is bounded at its top by an underside surface of a laterally extending longitudinally directed upper member. Each cavity is bounded at its bottom by an upper side surface of an imperforate bottom section. The bottom section has a bottom plate extending substantially laterally outward from a bottom portion of the vessel hull. Each cavity is bounded at its innermost section by the outer surface of the vessel hull and at its outermost section, by a longitudinally directed baffle extending between the upper member and the bottom section. The baffle has a plurality of vertically and longitudinally spaced, wave energy dissipating openings. The vessel, in this particular embodiment, also includes at least a pair of buoyancy chambers, one chamber on the starboard side of the vessel and one chamber on the port side of the vessel, substantially as described above.

DESCRIPTION OF THE DRAWINGS

Other features, objects and advantages of the invention will appear from the following description of particular preferred embodiments of the invention when taken together with the following drawings in which.

DESCRIPTION OF A PREFERRED EMBODIMENT

Figure 1:
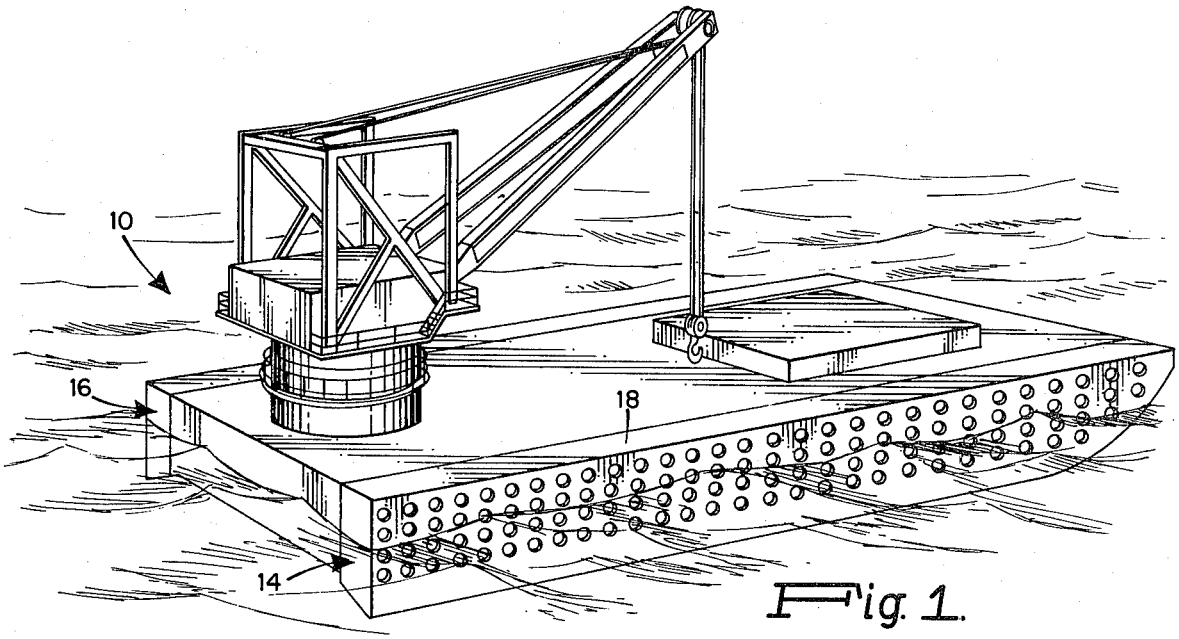
FIG. 1 is a perspective view of a vessel constructed according to the invention.

Referring to FIG. 1, the invention is typically used with a large vessel 10, for example a barge used in oil exploration, to reduce motions of the vessel under adverse wave conditions. Typically, vessel 10 because of its large mass, has a relatively long natural period for roll and is not significantly affected by waves having a period of less than about five seconds. Nevertheless, the barge is affected by waves having a period of from five to ten seconds and tends to move in response to waves in this frequency range to an undesirable extent.

A significant reduction in the motion of the vessel and a significant reduction in the reflective wave effect upon nearby service vessels (not shown) are achieved by either adding to the vessel if it is old, or building into the vessel if it is under construction, water accessible tanks or cavities 14 and 16, one tank 14 being provided on the starboard side of the vessel and another tank 16 being provided on the port side of the vessel. The two tanks illustrated in the figures extend substantially the entire length of the vessel, however, in general, they may be of any longitudinal length and there may be more than one tank or cavity on each side of the vessel. The two illustrated tanks are substantially mirror images of each other. Only tank 14 shall be described in detail, it being understood that tank 16 is, in the preferred embodiment, the mirror image of tank 14.

Tank 14 is defined by a laterally extending, imperforate upper member 18, for example a laterally extending deck portion, an essentially extending bottom plate or section 22 (FIG. 4), and at least one longitudinally extending, perforate bulkhead or baffle plate 20. The illustrated embodiment also includes a plurality of vertically oriented, transversely directed perforate plates 24.

It should become obvious from the following description of the invention that the invention can be configured in many different ways. Preferably, upper member 18 is an extension of and has an upper surface flush with a deck 26 and extends laterally outward from the vessel. However, in other embodiments according to the invention, the upper surface of upper member 18 need not be flush with the deck 26. Similarly, bottom plate 22 generally extends laterally outward at or near the bottom of the vessel; and, in the preferred embodiment wherein vessel 10 is a barge, bottom plate 22 is an extension of bottom 28 of the barge and extends essentially parallel to the bottom. Nevertheless, in other embodiments according to the invention, bottom plate 22 may be sloped, for example, along a line which passes through the theoretical center of roll, and may extend outwardly beyond tank 14. The longitudinal bulkhead plate 20 is positioned between and is preferably connected to bottom plate 22 and upper member 18 at laterally outward edges 30, 32 of bottom plate 22 and upper member 18 respectively for substantially the entire length of the tank (and in the illustrated embodiment the entire length of the vessel). The connection may be, for example, by welding. Longitudinal plate 20 has a plurality of vertically and longitudinally spaced, wave energy dissipating openings which allow relatively free passage of the sea in which the vessel floats to the tanks. The open area of longitudinal bulkhead 20 may be in the range, for example, of 25–55%, and preferably is in the range of 30–45% and more preferably is about 35–40%, although open areas larger than or smaller than the preferred range will also provide some of the advantages of the invention. (In other embodiments of the invention, as noted above, bottom plate or section 22 may extend beyond plate or baffle 20.)

Transverse plates 24 are spaced along the length of the cavity and are secured between the vessel's outside hull 34, plate 22 and upper member 18. Plates 24 are sufficiently perforate to provide for the relatively free movement of water between longitudinally spaced compartments 36 formed by the plates 24 in tank 14. Compartments 36 in cavity or tank 14 each thus have at least two perforate side walls. Plates 24 may have an open area of 30–60%, preferable is in the range of 40–60%, and more preferably is approximately 50%.

Figure 8:
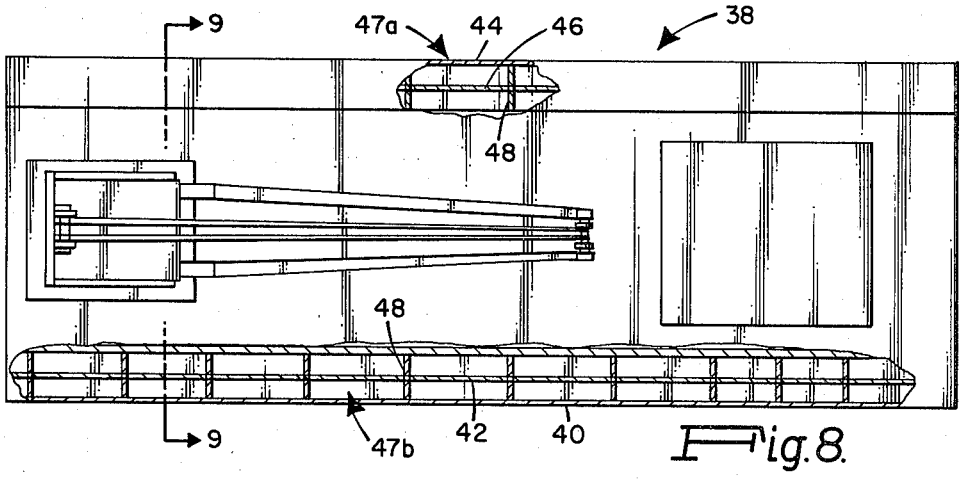
FIG. 8 is a top view, partially cut away, of a vessel showing an alternative embodiment of the invention.
Figure 9:
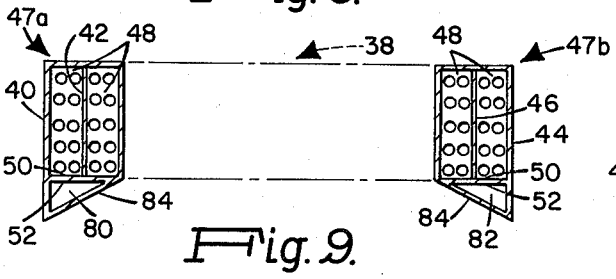
FIG. 9 is a cross-sectional view taken along lines 9—9 of FIG. 8.

While in the preferred embodiment, one longitudinal bulkhead is used, in other embodiments it may be desirable to use more than one longitudinal bulkhead plate as shown in FIG. 8. In those instances, where more than one longitudinal bulkhead is used (FIGS. 8–12), the construction of the tank is substantially unchanged; however, the number of compartments 36 into which the tank is divided, is at least doubled with compartments 36 being spaced both longitudinally and laterally of the vessel. Referring to FIGS. 8 and 9, a vessel 38 has two perforate longitudinal bulkheads or baffles 40, 42, and 44, 46 associated with each tank or cavity 47*a*, 47*b* respectively. These tanks, 47*a*, 47*b*, except for the addition of bulkheads 42 and 46, may be substantially identical in structure to tanks 14, 16 of the vessel 10. Thus bulkheads 40, 42, 44, 46 most preferably have an open area of about 35–40% and the perforated transverse plates 48 are essentially the same as transverse plates 24 and thus have an open area most preferably of approximately 50%. For ease of construction, plates 48 may each be comprised of two sections in order to allow for easier assembly of the tank or cavity.

Significantly, no matter how many longitudinal bulkheads are used, bottom plate 22 should be freely accessible to water from both topside 50 and underside 52. This is important in order to provide reduced motion of the vessel; that is, the pressure differential existing across the bottom plate effectively dampens the wave response of the vessel. This is so however only if the thickness of the bottom plate is no greater than about one-fifth the lateral extent of the plate and is true even if the plate is somewhat perforate, for example, between about 3–12% and preferably about 5–8% open area.

In those instances when it is desirable to counterbalance the weight of upper member 18 and plates 20 (or 40, 42, 44, 46), 22 and 24 (or 48), a plurality of buoyancy chambers may be provided. In the illustrated embodiments, the buoyancy chambers are positioned beneath bottom plates 22, which are then imperforate, for the full longitudinal length of the plates. In other embodiments of the invention the buoyancy chambers may be located at any convenient position on the vessel. This enables the vessel 10 to float at approximately the same position in the water even though its mass is considerably increased. Thus, the mean water line of the vessel remains unchanged.

Figure 4:
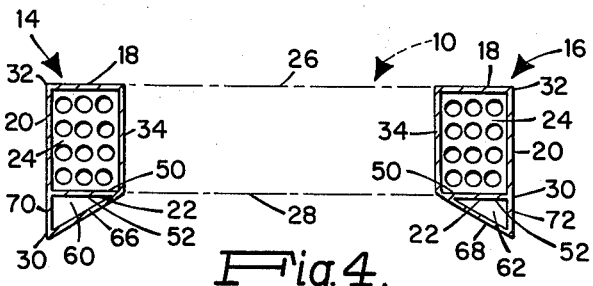
FIG. 4 is a cross-sectional view taken along lines 4—4 of FIG. 2.
Figure 5:
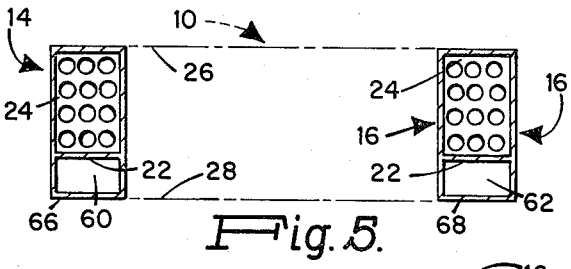
FIGS. 5–7 are cross-sectional views of alternate configurations of the vessel of FIG. 1 according to the invention.
Figure 6:
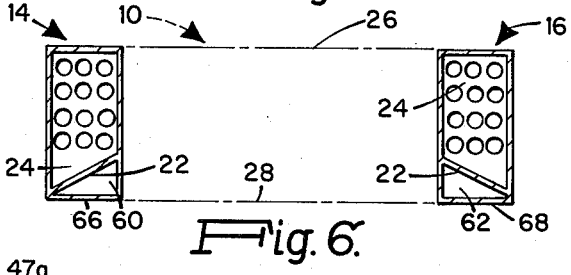
Figure 7:
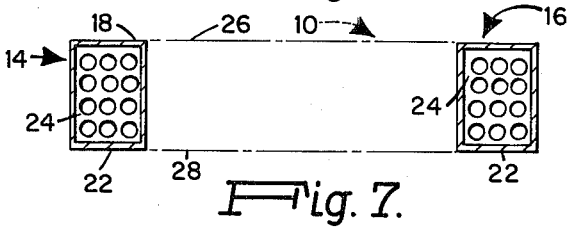

Although the buoyancy chambers may be positioned anywhere on the vessel, when they are positioned beneath the cavities or tanks, the maximum vertical height of each buoyancy chamber must be limited, as described below, to maintain the damping effectiveness of the bottom plates. Referring in particular to FIG. 4, vessel 10 is shown equipped with tanks 14 and 16 and buoyancy chambers 60 and 62. In other embodiments, the configuration of tanks 14, 16 and the buoyancy chambers 60, 62 may vary (as shown in FIGS. 5 and 6). Any one configuration may be chosen according to the conditions encountered during construction or retrofitting of the vessel. (As noted above, in other embodiments, according to the invention, the buoyancy chambers may not be necessary and are not provided (not for example, FIG. 7).) Illustrated buoyancy chambers 60 and 62 use the underside 52 of bottom plate 22 to define one boundary of the chamber, and have outwardly and preferably downwardly directed, imperforate underplates 66 and 68 respectively as a second boundary of the tank. Illustrated chambers 60 and 62 are sealed with longitudinal closure plates 70, 72 however other means to sealingly connect bottom plates 22 with underplates 66 and 68 may be provided. (See for example FIG. 6 where plates 22 and 66, 68 are directed toward each other so that they may be welded together.)

The maximum vertical distance between the top surface of bottom plates 22 and the bottom surface of underplates 66, 68 must be small enough, and is preferably no greater than about one-fifth the lateral width or extent of the byoyancy chambers, to maintain the effective damping feature of the cavity construction to reduce vessel motions. The buoyancy chambers are preferably provided with means (not shown) to receive and discharge fluids, thereby providing the flexibility of changing their buoyancy, as is well known in the art.

Figure 2:
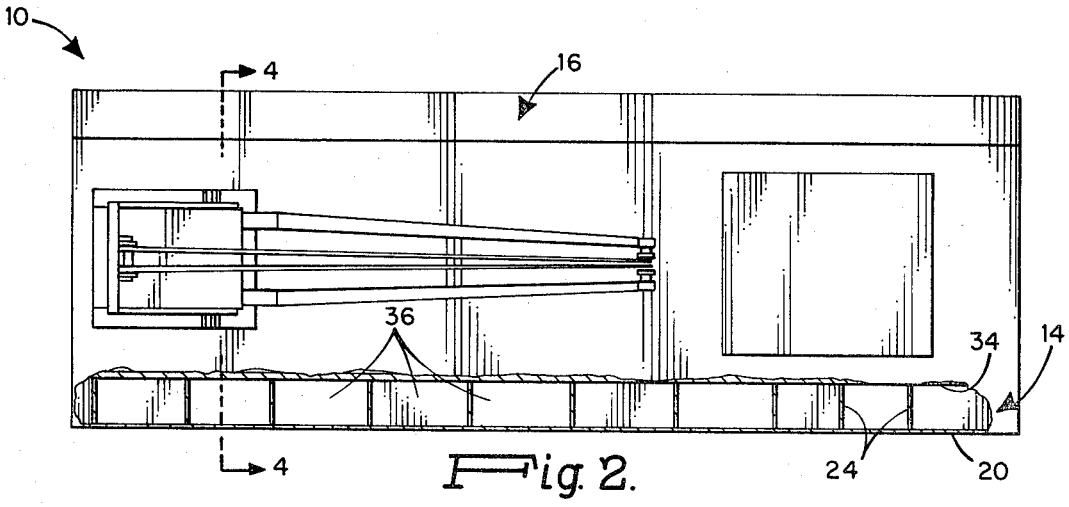
FIG. 2 is a top view of the vessel of FIG. 1.
Figure 3:
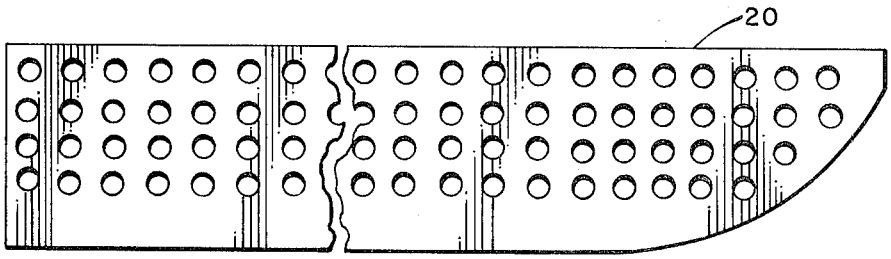
FIG. 3 is a side elevational view of the perforated longitudinal bulkhead plates of the vessel of FIG. 1 according to the invention.

A model built according to the embodiment of the invention shown in FIG. 2, exhibited, in tank tests, significantly less heave, roll, and reflected wave motion than the same vessel without the cavity or tanks.

Figure 10:
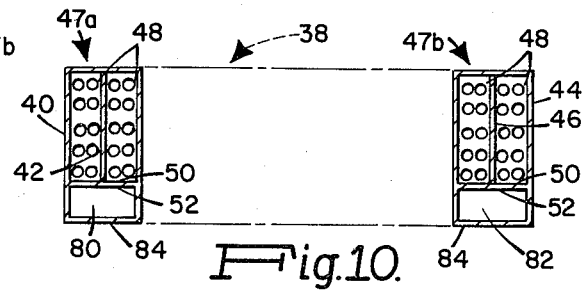
FIGS. 10–12 are cross-sectional views of alternate configurations of the vessel of FIG. 8 according to the invention.
Figure 11:
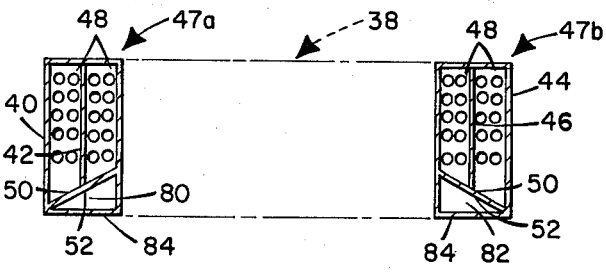
Figure 12:
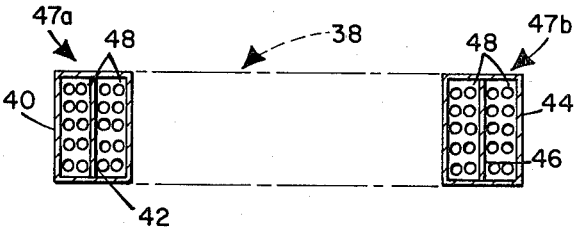

Buoyancy chambers may also be provided and are illustrated in connection with embodiments of the invention (FIGS. 8–11) using more than one longitudinal bulkhead plate. Referring to FIGS. 8 and 9, buoyancy chambers 80 and 82 are provided beneath cavities 47*a*, 47*b* to compensate for the weight of the tank structure. In other embodiments of the invention wherein more than one longitudinal bulkhead plate is used, the configuration of the buoyancy chambers 80, 82 may vary as illustrated in FIGS. 10 and 11 where like reference numbers designate like parts. (In addition, as illustrated in FIG. 12, the buoyancy chambers may not be needed or they may located other than beneath the tanks or cavities 47*a*, 47*b*.) The same maximum height requirement which is imposed upon chambers 60, 62 is of course also imposed here, if the chambers 80, 82 are positioned beneath the cavities 47*a*, 47*b*. Thus, the maximum vertical distance between the upper surface 50 of the bottom plate and the lower surface of underplates 84 should be no greater than one-fifth the lateral extent of the buoyancy chambers.

Figure 13:
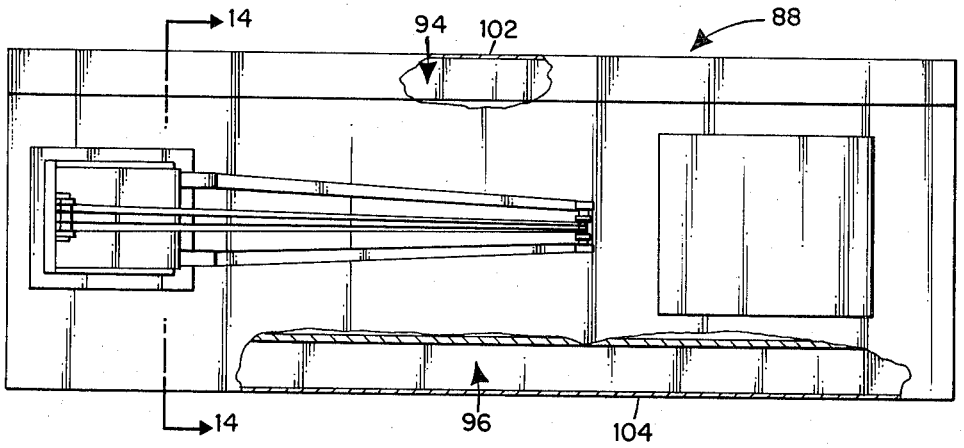
FIG. 13 is a top view, partially cut away, of another particular embodiment of the invention.
Figure 14:
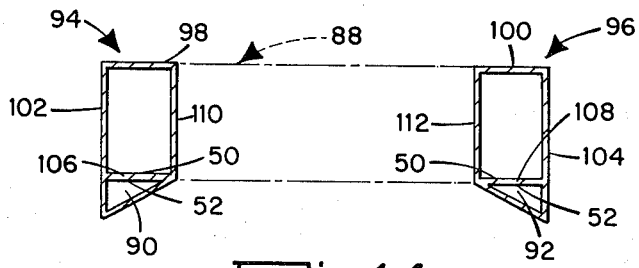
FIG. 14 is a cross-sectional view taken along lines 14—14 of FIG. 13.

Referring to FIGS. 13 and 14, in another embodiment of the invention, a vessel 88 having no transverse plates may be provided with buoyancy chambers 90, 92 beneath cavities 94, 96. Cavities 94, 96 are defined by upper members 98, 100, perforate bulkheads 102, 104, bottom plate sections 106, 108, and the vessel hull portions 110, 112, respectively. While only one longitudinal bulkhead is illustrated, a plurality of spaced longitudinal bulkheads could be used. The vertical dimensions of the buoyancy chambers in this embodiment are similarly subject to the maximum vertical height restrictions imposed upon chambers 60, 62 and 80, 82 if the chambers are positioned beneath the respective cavities 94, 96.

Figure 15:
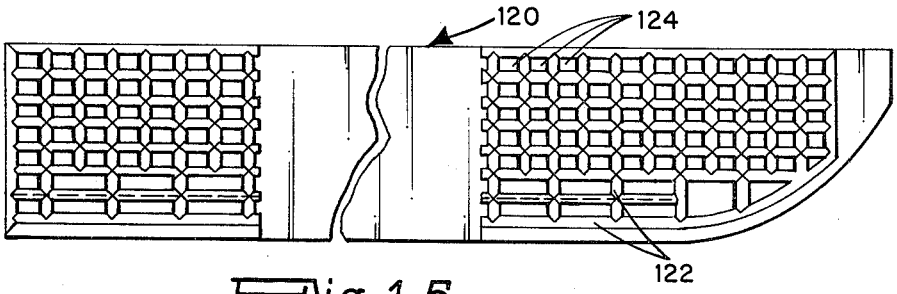
FIG. 15 is a side elevational view of a vessel which has been retrofitted with perforated longitudinal bulkhead plates according to the invention.

Referring to FIG. 15, in another particular embodiment of the invention, a particularly advantageous construction for retrofitting a vessel 120, already having bulkhead tanks, comprises securing, for example by welding, a plurality of half pipe sections 122 to the side of the vessel, preferably in a rectilinear array, and perforating, for example using an oxycetalene torch, the areas 124 defined between the pipe sections. As shown in the figure, the open areas 124 need not and in general do not have the same geometrical dimensions. Internal structural supports (not shown) may be provided if necessary.

Referring again to FIG. 15, an alternative form of construction is obtained by using hollow tubular or full pipe sections arranged to provide open areas 124. The advantage of this structure is that the tubular grid so formed can be proportioned so that its own buoyancy offsets the added weight of the structure. Transverse perforate plates 24 or 48 and longitudinal perforate plates 46 can also be constructed using the full tubular members to create similarly buoyant grids.

SUMMARY OF MAJOR ADVANTAGES AND UNOBVIOUSNESS

The invention provides vessels engaged in activities requiring a relatively motionless deck with means to reduce vessel motion without concomitant disadvantages of increasing other instabilities. In addition to reducing the motion of the vessel, the natural resonant frequency of the vessel is advantageously decreased because the mass and transverse gyradius of the vessel are increased.

The invention provides even further advantage by providing for buoyancy chambers to maintain or reduce the original draft of the vessel, which additionally decreases the natural frequency because the metacentric height is reduced.

In addition to reducing the motions of the vessel itself, the invention reduces reflective wave action whereby service boats near or alongside the larger barge or other vessel may operate without concern of adverse conditions due to reflected waves. This is achieved by dissipating the wave energy in the tank rather than reflecting it away from the vessel.

The reduction of the motion of floating bodies for various purposes has been accomplished in many ways. Thus, Jarlan, U.S. Pat. No. 3,299,846, issued Jan. 24, 1967, shows the use of a perforated thick shell to reduce the motion of a floating platform. Other researchers have directed their efforts to reducing the motions of vessels, for example Pangalila, U.S. Pat. No. 3,797,440, issued Mar. 19, 1974, and Michael, U.S. Pat. No. 3,965,837, issued June 29, 1976. In addition, other workers have provided various other means for reducing the motions of floating platforms, for example the lateral keel used by Kobus in connection with a floating drilling platform in U.S. Pat. No. 3,224,401, issued Dec. 21, 1965. The present invention however combines unique structural features in connection with a moving vessel in which the dynamics require more than that which is shown by the prior art. Applicants' combination of elements provides a vessel in which hitherto unachieved goals of motion stability are reached and at the same time, at least one disadvantage associated with reducing the motions of a vessel, that is, added reflected wave energy, is substantially eliminated.

Although the invention has been described in connection with preferred embodiments thereof, it will be appreciated by those skilled in the art that additions, subtractions, substitutions, and other modifications may be made within the scope of the invention as defined in the appended claims.

What is claimed is:

1. Apparatus for reducing the relative motions of a floating vessel comprising at least a pair of open tanks, one tank on the starboard side of said vessel and one tank on the port side of said vessel, each tank having a portion which extends above a means water line of the vessel and a portion which extends below the means water line of said vessel, each tank extending at least a portion of the longitudinal length of said vessel, each tank having a bottom plate extending substantially laterally outward from the bottom of the vessel for substantially the entire length of the tank, a deck portion extending laterally outward from the deck of said vessel for substantially the entire length of the tank, having substantially the same width as said bottom plate, and having an upper surface substantially flush with the deck surface;

a first plurality of transversely extending, substantially vertically aligned perforate plates, each transverse plate structurally connected between said vessel, said bottom plate, and said deck portion, and said transverse plates being spaced apart along the length of said tank, a perforate, longitudinally extending, vertically oriented plate extending substantially the length of the tank, said longitudinally extending plate being adjacent to said transverse plates and secured between said bottom plate and said deck portion, a second plurality of transversely extending, substantially vertically aligned, outwardly directed perforate plates, each second plate structurally connected between said longitudinally extending plate, said bottom plate, and said deck portion, and said plates being spaced apart along the length of said tank, and a second perforate, longitudinally extending vertically oriented plate extending substantially the length of the tank and connected between outward edge portions of said bottom plate and said deck portion, whereby an array of longitudinally and laterally spaced, wave energy dissipating cells are formed, each cell having at least two perforate side walls.

2. A floating vessel having apparatus for reducing its motions comprising an outer hull, at least one pair of water accessible cavities, one cavity on the starboard side of the vessel hull and one cavity on the port side of the vessel hull, each cavity A. having a portion which extends above a mean water line of the vessel and a portion which extends below the mean water line of the vessel, B. extending at least a portion of the longitudinal length of said vessel, C. being bounded at its top by an underside surface of a laterally extending, longitudinally directed upper member, D. being bounded at its bottom by an upper side surface of an imperforate bottom section, said section having a bottom plate extending laterally outward from a bottom portion of said vessel hull, E. being bounded at its innermost section by the outer surface of the hull of the vessel, and F. being bounded at its outermost section by a longitudinally directed baffle extending between said upper member and said bottom section and having a plurality of vertically and longitudinally spaced, wave energy dissipating openings, at least one pair of buoyancy chambers, one chamber on the starboard side of the vessel and one chamber on the port side of the vessel, each chamber being located beneath a cavity on the respective side of the vessel, and extending substantially the length of said cavity, each chamber having a. an upper boundary comprising an underside portion of said corresponding bottom section, b. an underplate which extends outwardly from said vessel, and c. means for sealingly connecting said bottom plate and said underplate, and the vertical distance between said bottom plate upper surface and said underplate lower surface being no greater than about one-fifth the lateral extent of said chamber.

3. The vessel of claim 2 wherein said underplate extends outward and downward from said vessel.

4. The vessel of claim 2 wherein each cavity is further divided by a plurality of perforate laterally directed members and at least one longitudinally directed member into an array of energy dissipating cells, spaced both laterally and longitudinally, each cell having energy dissipating openings in at least two cell walls.

5. A floating vessel having apparatus for reducing its relative motions comprising an outer hull, at least a pair of water accessible cavities, one cavity on the starboard side of said vessel hull and one cavity on the port side of said vessel hull, each cavity A. having a portion which extends above a mean water line of the vessel and a portion which extends below the mean water line of said vessel, B. extending at least a portion of the longitudinal length of said vessel, C. being bounded at its top by an underside surface of a laterally extending upper member, said upper member extending laterally outward from an above water portion of said vessel for substantially the entire length of the cavity, D. being bounded at its bottom by an upper side surface of a bottom section, said section having a bottom plate extending substantially laterally outward from a bottom portion of the vessel for substantially the entire length of the cavity, E. being bounded at its innermost section by the outer surface of the hull of the vessel, and F. having a longitudinally directed, vertically aligned, perforate bulkhead attached between said upper member and said bottom section and substantially enclosing said cavity, each perforate bulkhead comprising a plurality of interconnected hollow tubular sections, said sections providing a buoyant structure for offsetting at least a portion of the weight of the perforate bulkhead.

6. The vessel according to claim 5 wherein each said cavity further includes a plurality of transversely extending, substantially vertically aligned perforate plates, each transverse plate being structurally secured within said cavity, said plates being spaced apart along the length of said cavity to divide said cavity into a plurality of longitudinally spaced, water accessible compartments.

7. The vessel of claim 6 wherein said transverse plates are each comprised of a plurality of interconnected hollow tubular sections.

8. A floating vessel having apparatus for reducing its relative motions comprising an outer hull, at least a pair of water accessible cavities, one cavity on the starboard side of said vessel hull and one cavity on the port side of said vessel hull, each cavity A. having a portion which extends above a mean water line of the vessel and a portion which extends below the mean water line of said vessel.

B. extending at least a portion of the longitudinal length of said vessel,

C. being bounded at its top by an underside surface of a laterally extending upper member, said upper member extending laterally outward from an above water portion of said vessel for substantially the entire length of the cavity, D. being bounded at its bottom by an upper side surface of a bottom section, said section having a bottom plate extending substantially laterally outward from a bottom portion of the vessel for substantially the entire length of the cavity, E. being bounded at its innermost section by the outer surface of the hull of the vessel, F. being divided into a plurality of longitudinally spaced, water accessible compartments by a plurality of transversely extending, substantially vertically aligned perforate plates, said transverse plate structurally secured between said hull, said bottom section, and said upper member, and said transverse plates being spaced apart along the length of said cavity, G. having a longitudinally directed, vertically aligned, perforate bulkhead attached between said upper member and said bottom section and substantially enclosing said cavity, and H. having at least one perforated plate means, each plate means being vertically aligned and extending longitudinally of the vessel and said plate means being spaced substantially equidistant between said bulkhead and said hull whereby said cavity is divided into a plurality of substantially equal sections, each section being divided into a pluraity of said longitudinally spaced compartments.

9. The floating vessel of claim 8 wherein each cavity includes one perforated plate means and each cavity is thereby divided into two substantially equal sections.

10. A floating vessel having apparatus for reducing its relative motions comprising an outer hull, at least a pair of water accessible cavities, one cavity on the starboard side of said vessel hull and one cavity on the port side of said vessel hull, each cavity A. having a portion which extends above a mean water line of the vessel and a portion which extends below the mean water line of said vessel.

B. extending at least a portion of the longitudinal length of said vessel,

C. being bounded at its top by an underside surface of a laterally extending upper member, said upper member extending laterally outward from an above water portion of said vessel for substantially the entire length of the cavity, D. being bounded at its bottom by an upper side surface of a bottom section, said section having a bottom plate extending substantially laterally outward from a bottom portion of the vessel for substantially the entire length of the cavity, E. being bounded at its innermost section by the outer surface of the hull of the vessel, F. being divided into a plurality of longitudinally spaced, water accessible compartments by a plurality of transversely extending, substantially vertically aligned perforate plates, said transverse plate structurally secured between said hull, said bottom section, and said upper member, and said transverse plates being spaced apart along the length of said cavity, and G. having a longitudinally directed, vertically aligned, perforate bulkhead attached between said upper member and said bottom section and substantially enclosing said cavity, and at least a pair of buoyancy chambers, one chamber on the starboard side of the vessel and one chamber on the port side of the vessel, each chamber being located beneath the cavity on the respective side of the vessel, each chamber extending for a substantial length of said cavity, each chamber having an upper boundary comprising an underside portion of said corresponding bottom plate, an underplate which extends outwardly from said vessel, and means for sealingly connecting said bottom plate and said underplate, said bottom plate being imperforate, and the maximum vertical distance between the upper surface of said bottom plate and the bottom surface of said underplate being no greater than about one-fifth the maximum lateral width of said chamber.

11. Apparatus for reducing the relative motions of a floating vessel comprising at least one pair of open tanks, one tank on the starboard side of said vessel and one tank on the port side of said vessel, each tank A. having a portion which extends above a mean water line of the vessel and a portion which extends below the mean water line of said vessel, B. extending at least a portion of the longitudinal length of said vessel, C. having a bottom plate extending substantially laterally outward from a bottom portion of the vessel for substantially the entire length of the tank, D. having an upper member extending laterally outward from an upper portion of said vessel for substantially the entire length of the tank and having substantially the same width as said bottom plate, E. having a plurality of transversely extending, substantially vertically aligned perforate plates, each transverse plate structurally being secured between said vessel, said bottom plate, and said upper member, and said transverse plates being spaced apart along the length of said tank, and F. having two longitudinally extending vertically oriented plates extending substantially the length of the tank, said longitudinally extending plates being secured between said bottom plate and said upper member, and said longitudinal plates being spaced apart from said vessel, one plate being about twice the distance from the vessel as the other plate, whereby each tank is divided into a plurality of longitudinally and laterally spaced wave energy dissipating cells, each cell having openings in at least two of its side walls.

12. Apparatus for reducing the relative motions of a floating vessel comprising at least one pair of open tanks, one tank on the starboard side of said vessel and one tank on the port side of said vessel, each tank A. having a portion which extends above a mean water line of the vessel and a portion which extends below the mean water line of said vessel, B. extending at least a portion of the longitudinal length of said vessel, C. having a bottom plate extending substantially laterally outward from a bottom portion of the vessel for substantially the entire length of the tank, D. having an upper member extending laterally outward from an upper portion of said vessel for substantially the entire length of the tank and having substantially the same width as said bottom plate, E. having a plurality of transversely extending, substantially vertically aligned perforate plates, each transverse plate structurally being secured between said vessel, said bottom plate, and said upper member, and said transverse plates being spaced apart along the length of said tank, and F. having at least one perforate, longitudinally extending, vertically oriented plate extending substantially the length of the tank, said one longitudinally extending plate being secured between said bottom plate and said upper member, and at least one pair of buoyancy chambers, one chamber on the starboard side of the vessel and one chamber on the port side of the vessel, each chamber being located beneath the tank on the respective side of the vessel, each chamber extending for a substantial length of said respective tank, each chamber having an upper boundary comprising an underside portion of said corresponding bottom plate, an underplate which extends outwardly from said vessel, and means for sealingly connecting said bottom plate and said underplate, said bottom plate being imperforate, and the vertical distance between an upper surface of said bottom plate and an under surface of said underplate always being less than about one-fifth the maximum lateral width of said chamber.

13. The apparatus of claim 12 wherein said underplate extends outward and downward from said vessel.

14. The apparatus of claim 13 wherein said underplate and said bottom plate have a common connection line with said vessel.

* * * * *